US007086109B2

(12) United States Patent
Fisher et al.

(10) Patent No.: US 7,086,109 B2
(45) Date of Patent: Aug. 8, 2006

(54) SCREWDRIVER WITH HAMMER END

(75) Inventors: Kathleen Fisher, Lindenhurst, IL (US); Jeffrey A. DeBoer, Ann Arbor, MI (US); Michael Nellenbach, Clawson, MI (US)

(73) Assignee: The Faucet Queens, Inc., Vernon Hills, IL (US)

( * ) Notice: Subject to any disclaimer, the term of this patent is extended or adjusted under 35 U.S.C. 154(b) by 0 days.

(21) Appl. No.: 10/980,064

(22) Filed: Nov. 3, 2004

(65) Prior Publication Data

US 2006/0090265 A1 May 4, 2006

(51) Int. Cl.
*B25B 15/00* (2006.01)

(52) U.S. Cl. ..... 7/165; 7/143; 81/492

(58) Field of Classification Search ..... 7/143, 7/165; 81/492
See application file for complete search history.

(56) References Cited

U.S. PATENT DOCUMENTS

| | | | | |
|---|---|---|---|---|
| 200,932 | A * | 3/1878 | Parrish | 81/492 |
| 401,481 | A * | 4/1889 | Carlisle | 81/492 |
| 403,832 | A * | 5/1889 | Fuller | 81/492 |
| 412,390 | A * | 10/1889 | Jaquith | 81/492 |
| 1,717,562 | A * | 6/1929 | Howard | 81/492 |
| 3,216,471 | A * | 11/1965 | Wendel | 81/436 |
| 4,016,912 | A | 4/1977 | St-Amour | |
| 4,552,044 | A | 11/1985 | Corona et al. | |
| 4,739,536 | A | 4/1988 | Bandera et al. | |
| 4,858,504 | A | 8/1989 | Tsai | |
| 5,321,999 | A | 6/1994 | Lin | |
| 5,673,758 | A | 10/1997 | Sasaki et al. | |
| 6,135,212 | A | 10/2000 | Georgiou | |
| 6,176,161 | B1 | 1/2001 | Huang et al. | |
| 6,250,187 | B1 | 6/2001 | Ju et al. | |
| 6,530,098 | B1 | 3/2003 | Gringer et al. | |
| 6,922,864 | B1 * | 8/2005 | Clarke et al. | 7/143 |
| 2004/0129119 | A1 * | 7/2004 | Clarke et al. | 81/439 |

* cited by examiner

*Primary Examiner*—David B. Thomas
(74) *Attorney, Agent, or Firm*—Carlson, Gaskey & Olds

(57) ABSTRACT

A screwdriver is equipped with a striking surface. The striking surface is partially embedded within the screwdriver handle and includes an exposed face portion which is offset from a longitudinal axis. A shank protrudes from the handle along the longitudinal axis and includes a receiving end for a bit. The screwdriver functions as both a screwdriver and a hammer.

21 Claims, 5 Drawing Sheets

SCREWDRIVER WITH HAMMER END

BACKGROUND OF THE INVENTION

The present invention relates to a screwdriver, and more particularly to a screwdriver equipped with a hammer surface.

Conventional screwdrivers generally include a handle and a shank with a functional end. The functional end is used to engage a threaded fastener. While utilizing the screwdriver it may become necessary to tap objects into place.

Screwdrivers with some functionality to operate as a hammer are known. Screwdrivers of this type typically use an impact rod and spring configuration to exert a load to seat a fastener. Disadvantageously, these screwdrivers are relatively complicated and expensive. Screwdrivers with a longitudinal end for striking with a hammer are also known. These relatively simple screwdrivers utilize a heavy shank as the striking, which may limit the tool's functionality as a screwdriver.

Accordingly, it is desirable to provide a screwdriver with a hammer surface which is uncomplicated and that does not detract from the primary screwdriver function.

SUMMARY OF THE INVENTION

The screwdriver of the present invention provides a hammer surface for tapping objects into place in addition to providing the functionality of a conventional screwdriver.

The present invention includes a handle, a shank and a striking member. The striking member is partially embedded into the handle of the screwdriver. A face portion of the striking member is exposed on at least one side of the axis. The face portion of the striking member is perpendicular to the fastener when striking.

The shank is located at an end opposite from the member. The shank includes a receiving end for a bit, the bit being capable of engaging a fastener. portion of the striking surface is exposed on at least one side of the axis. The face portion of the striking surface is perpendicular to the fastener when striking.

The shank is located at an end opposite from the striking surface. The shank includes a receiving end for a bit, the bit being capable of engaging a fastener.

The screwdriver of the present invention provides an uncomplicated tool which functions both as a hammer and a conventional screwdriver.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
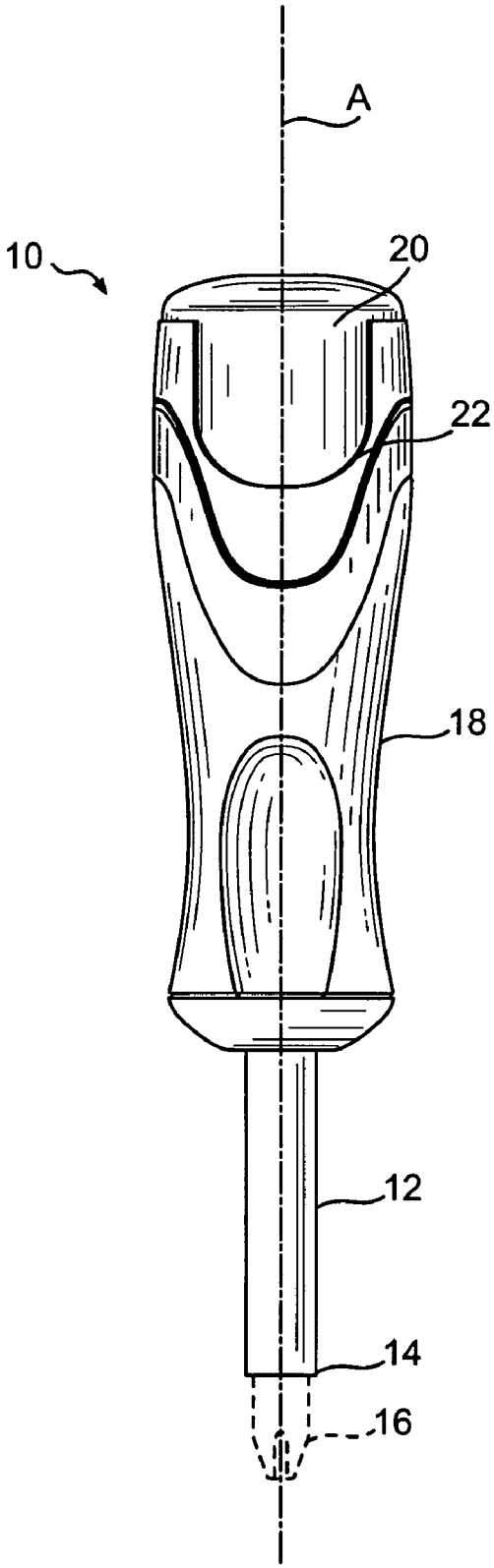
FIG. 1 is a general perspective view of the screwdriver in accordance with the present invention.

FIG. 1 illustrates a general perspective view of the screwdriver 10 of the present invention. A shank 12 has the general form of a rod having at one end a receiving end 14 for a removable bit 16. The bit 16 can be of the phillips head type or of the flat head type as well as of any other type.

A handle 18 is formed around a portion of the shank 12 at an end opposite the receiving end 14 of the shank 12. The handle 18 defines a longitudinal axis A along the length thereof. The handle 18 is preferably manufactured of a resilient material such as rubber and/or plastic. It should be understood that other materials may be utilized in the construction of the handle of the present invention.

A striking member 20 is partially embedded into a cup shaped portion 22 of the handle 18 at an end opposite the shank 12. The longitudinal axis A passes through the striking member 20. The striking member 20 is preferably manufactured of a metallic material. It should be understood that other materials may be utilized in the construction of the striking member of the present invention.

Figure 2:
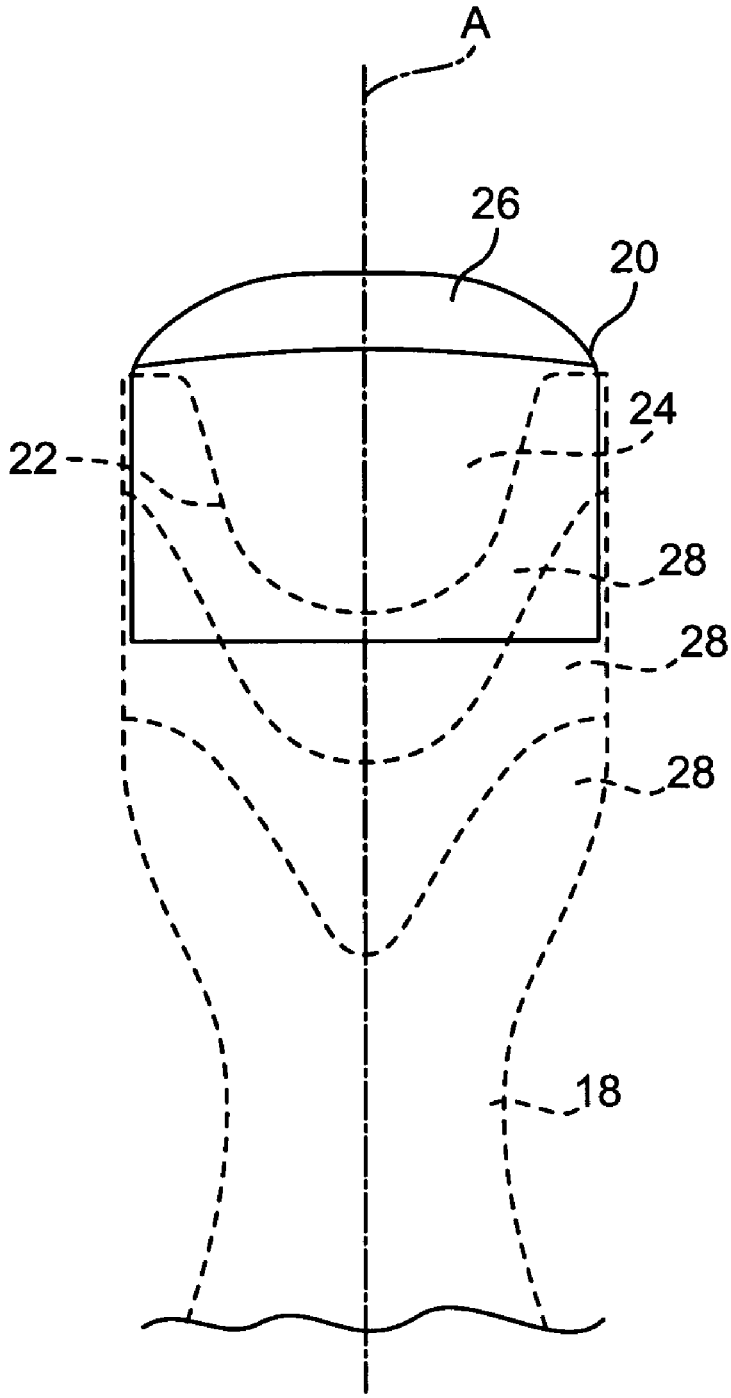
FIG. 2 is an illustrative view of the striking member end of the screwdriver of the present invention.

Referring to FIG. 2, the striking member 20 is a solid cylindrical member. The striking member 20 defines a face portion 24 and a head portion 26. The face portion 24 is exposed on at least one side of the handle 18 and is offset from longitudinal axis A. That is, the face portion 24 is parallel to the longitudinal axis A. Preferably the face portion 24 is exposed on two sides of the handle 18 offset from longitudinal axis A. The head portion 26 of the striking member 20 is perpendicular to the face portion 24. The head portion 26 has a convex shape and is exposed at the end of the handle 18. Longitudinal axis A passes through the center of the head portion 26.

The striking member 20 is preferably at least partially embedded into the cup shaped portion 22 of the handle 18. The cup shaped portion 22 of the handle 18 is preferably a scalloped shaped cup. Grip contours 28 blend into a scalloped cup shape around the striking member 20 for gripping purposes and to ensure the striking member 20 is securely fitted into the cup shaped portion 22 of the handle 18.

Figure 3:
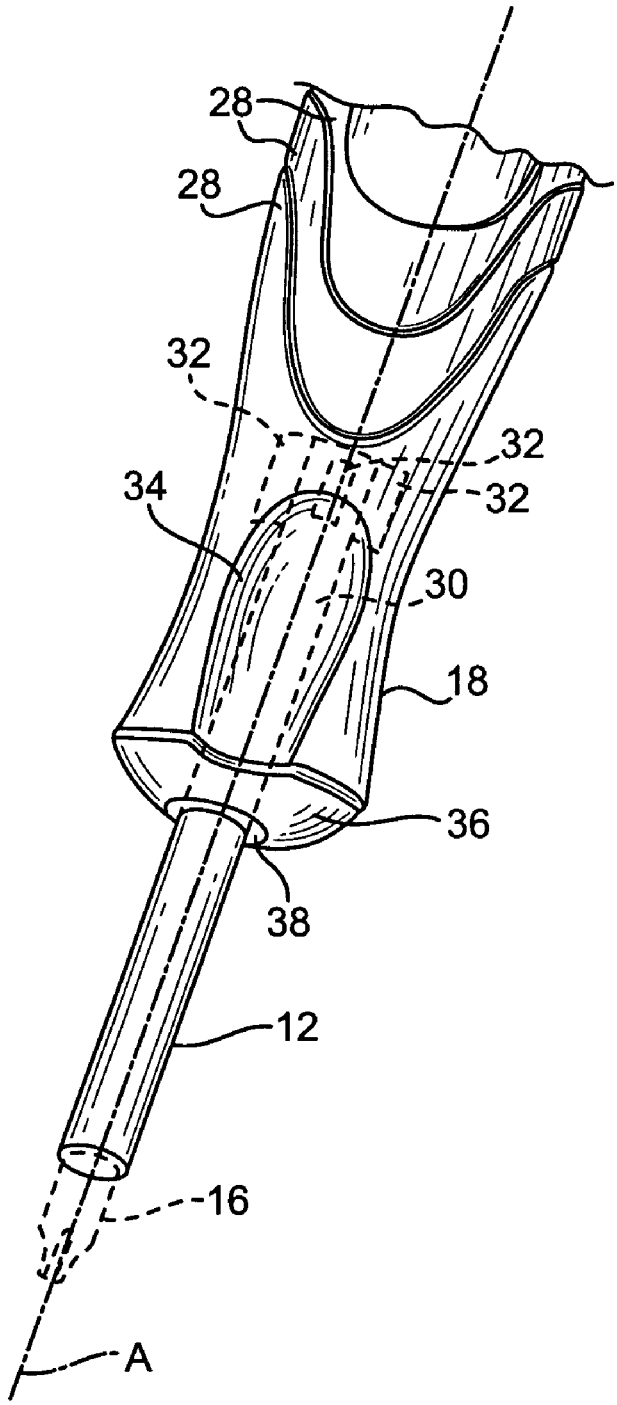
FIG. 3 is an illustrative view of the shank end of the screwdriver of the present invention.

Referring to FIG. 3, a centrally apertured body 30 receives a portion of the shank 12 for securing the shank 12 to the handle 18. The shank 12 is bonded to the handle 18 therein with a lock structure 32. The lock structure 32 securely fastens the shank 12 within the handle 18 to resist torsional forces. The shank 12 extends partially through the length of handle 18. The handle 18 includes a plurality of finger grips 34 for improved gripping of the screwdriver 10 when utilizing the tool to tighten or loosen a fastener or to tap an object into place.

A shank face plate 36 with a hole 38 in the center thereof for the shank 12 is located at the end of the handle 18. The shank face plate 36 serves as an aesthetically pleasing and more ergonomic means of housing the transition of the shank 12 with the handle 18 to the exposed portion of shank 12 outside of the handle 18.

Figure 4:
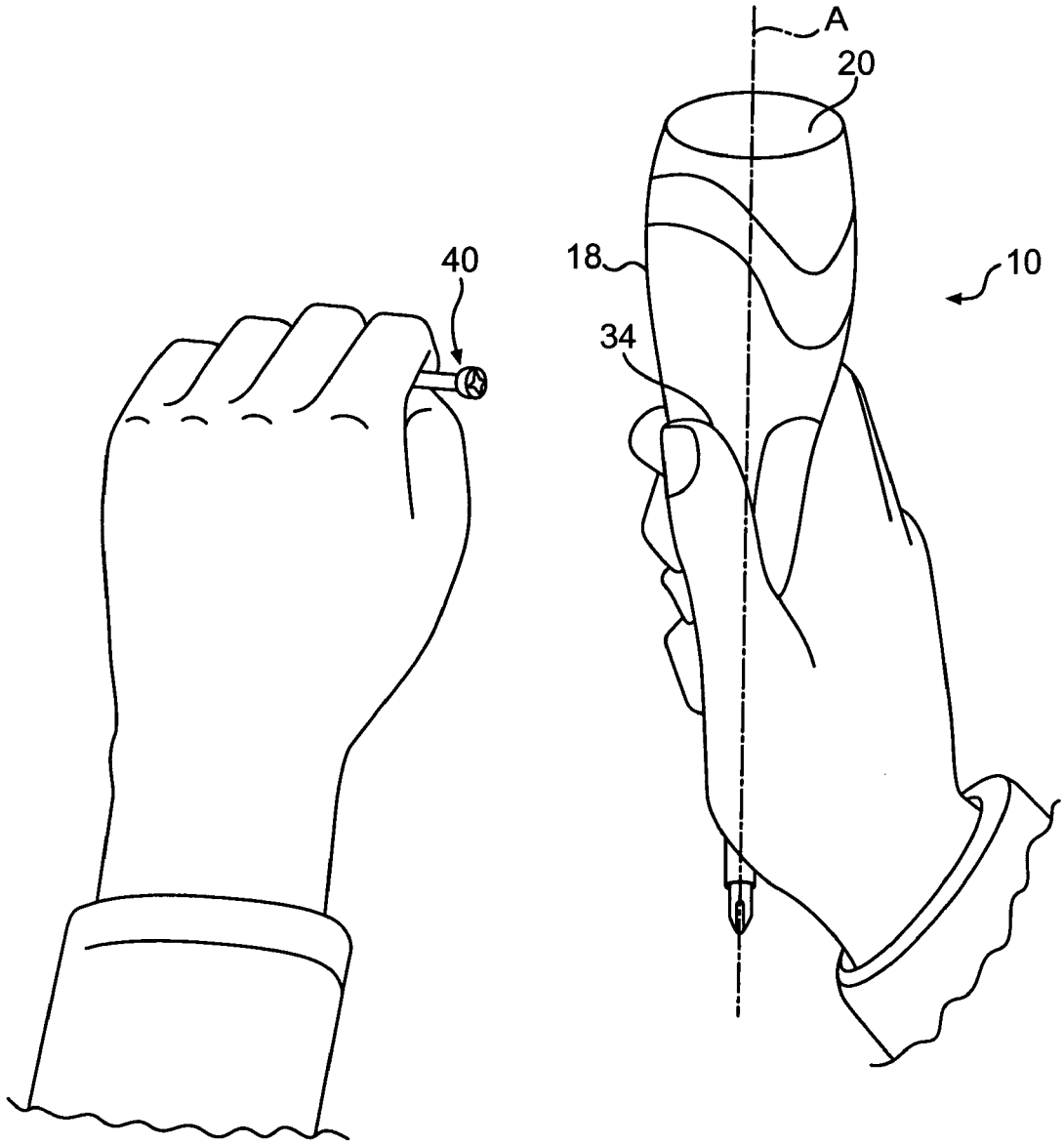
FIG. 4 is a schematic representation of a use of the screwdriver of the present invention.

Referring to FIG. 4, the striking member 20 of the screwdriver 10 is used to tap in a fastener 40. The finger grips 34 allow for increased grip of the screwdriver 10 and isolate the hand from impact when utilizing the striking member 20. The longitudinal axis A and the striking member 20 are perpendicular to the fastener 40 when striking.

Figure 5:
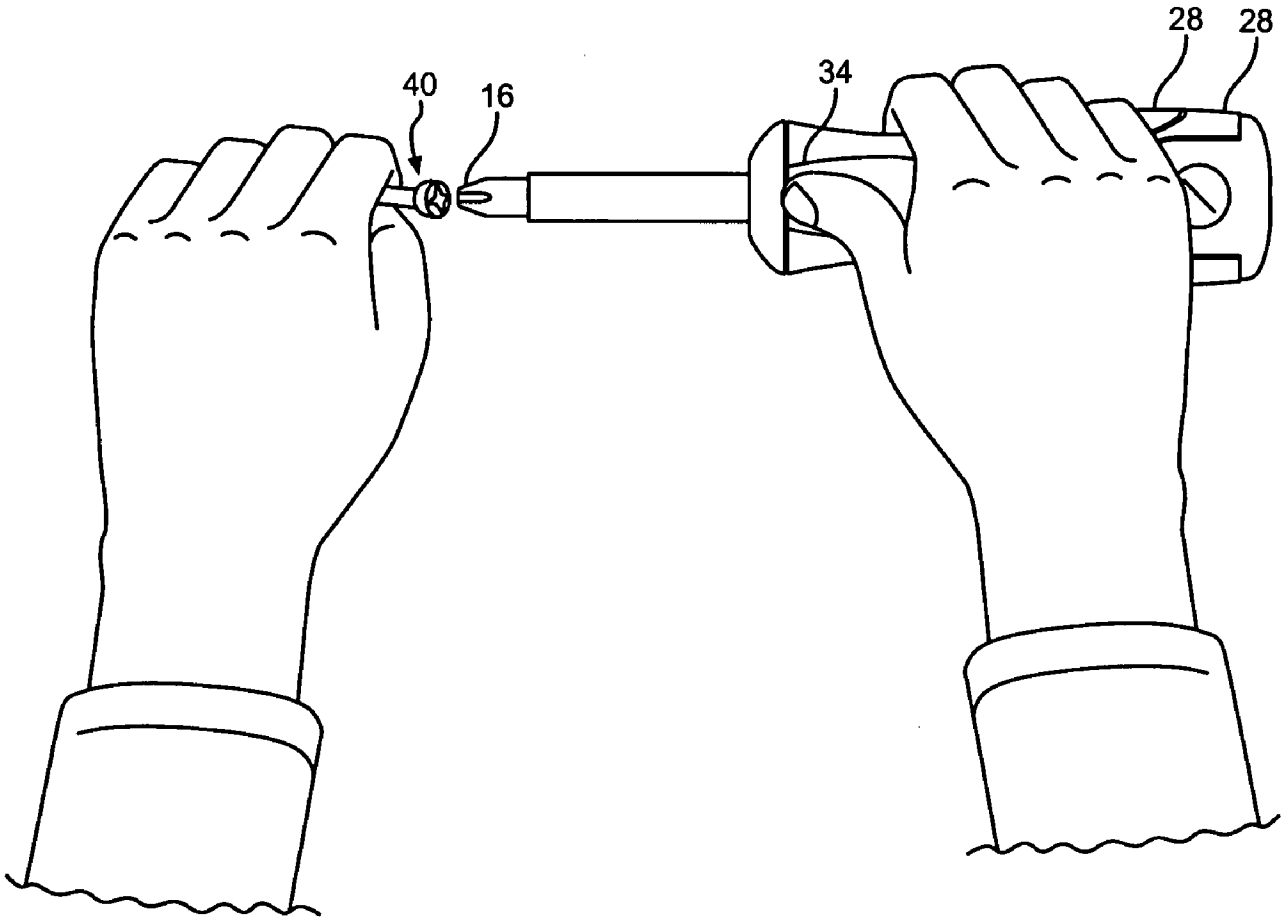
FIG. 5 is a second schematic representation of a use of the screwdriver of the present invention.

Referring to FIG. 5, the bit 16 is being used to tighten/loosen a fastener 40. The finger grips 34 and the grip contours 28 allow for an increased grip and a more ergonomic feel to handle 18.

That the foregoing description shall be interpreted as illustrative and not in a limiting sense is thus made apparent. A worker of ordinary skill in the art would recognize that certain modifications would come within the scope of this invention. For that reason, the following claims should be studied to determine the true scope and content of this invention.

What is claimed is:

1. A screwdriver, comprising:

a handle which defines a longitudinal axis;

a shank mounted to said handle, said shank extending axially along said longitudinal axis to define a bit end segment opposite said handle; and a striking member mounted to said handle, said striking member defining a head portion which defines an end segment of said handle which intersects said longitudinal axis and a face portion offset from said longitudinal axis, said face portion located between said head portion and said shank.

2. The screwdriver as recited in claim 1, wherein said striking member is partially embedded in said handle.

3. The screwdriver as recited in claim 2, wherein said handle defines a cup shape which receives said striking surface.

4. The screwdriver as recited in claim 3, wherein said cup shape defines a multitude of scallops such that said face portion is at least partially exposed through at least one of said multitude of scallops.

5. The screwdriver as recited in claim 1, wherein said head portion is transverse to said face portion.

6. The screwdriver as recited in claim 5, wherein said head portion is convex.

7. The screwdriver as recited in claim 1, wherein said face portion of said striking member is exposed on at least one side of said handle and operative to impact a fastener transverse to said longitudinal axis.

8. The screwdriver as recited in claim 1, wherein said bit end segment includes a receiving end for a removable tool bit.

9. The screwdriver as recited in claim 1, wherein said bit end segment forms a tool bit.

10. The screwdriver as recited in claim 1, wherein said face portion extends from said head portion generally parallel to said longitudinal axis.

11. A screwdriver, comprising:

a handle having a scalloped cup shaped end segment;

a shank which extends from said handle opposite said cup shaped end segment, said shank having a bit end segment opposite said handle; and a striking member mounted at least partially within said scalloped cup shaped end segment, said striking member having a head portion and a face portion generally transverse to said head portion, said face portion generally parallel to said shank and at least partially exposed through at least one scallop of said scalloped cup shaped end segment.

12. The screwdriver as recited in claim 11, wherein said scalloped face portion of said striking member is exposed on at least one side of said handle and operative to impact a fastener transverse to said longitudinal axis.

13. The screwdriver as recited in claim 11, wherein said scalloped face portion extends along a length of said handle generally parallel to said longitudinal axis.

14. A screwdriver, comprising:

a handle which defines a longitudinal axis;

a shank mounted to said handle, said shank extending axially along said longitudinal axis; and a striking member partially embedded in a receiving end of said handle mounted, said striking member having a face portion offset from said longitudinal axis along said handle and said race portion blended into said handle.

15. The screwdriver as recited in claim 14, wherein said face portion of said striking member is exposed on at least one side of said handle to define a scalloped interface between said handle and said striking member.

16. The screwdriver as recited in claim 14, wherein said face portion of said striking member extends generally perpendicular to a head portion of said striking member.

17. The screwdriver as recited in claim 16, wherein said head portion forms an end of said handle.

18. The screwdriver as recited in claim 16, wherein said striking member is a generally cylindrical member inserted into a cup shaped end of said handle.

19. The screwdriver as recited in claim 16, wherein said cup shaped end of said handle is scalloped.

20. The screwdriver as recited in claim 14, wherein said striking member is mounted within a scalloped hank cup shape end of said handle which defines a multitude of scallops such that said face portion is at least partially exposed through at least one of said multitude of scallops.

21. A screwdriver, comprising:

a handle which defines a longitudinal axis;

a shank extending axially along said longitudinal axis; and a striking member within said handle, said striking surface defining a face portion offset from said longitudinal axis, said striking member partially embedded in a scalloped cup-shaped receiving end of said handle at an end opposite from said shank.

* * * * *

UNITED STATES PATENT AND TRADEMARK OFFICE

CERTIFICATE OF CORRECTION

PATENT NO. : 7,086,109 B2
APPLICATION NO. : 10/980064
DATED : August 8, 2006
INVENTOR(S) : Fisher et al.

It is certified that error appears in the above-identified patent and that said Letters Patent is hereby corrected as shown below:

Claim 14, Column 4, line 20: "race" should be --face--

Signed and Sealed this

Twenty-fourth Day of October, 2006

JON W. DUDAS
*Director of the United States Patent and Trademark Office*